US010391784B2

(12) United States Patent
Ben-Zur et al.

(10) Patent No.: US 10,391,784 B2
(45) Date of Patent: Aug. 27, 2019

(54) CONCEALING MISSING NOZZLES

(71) Applicant: Kornit Digital Ltd., Rosh HaAyin (IL)

(72) Inventors: Ofer Ben-Zur, Hod-HaSharon (IL); Miri Gerenrot, Tel-Aviv (IL)

(73) Assignee: Kornit Digital Ltd., Rosh HaAyin (IL)

( * ) Notice: Subject to any disclaimer, the term of this patent is extended or adjusted under 35 U.S.C. 154(b) by 0 days.

(21) Appl. No.: 15/766,010

(22) PCT Filed: Oct. 5, 2016

(86) PCT No.: PCT/IL2016/051080

§ 371 (c)(1),
(2) Date: Apr. 5, 2018

(87) PCT Pub. No.: WO2017/060602

PCT Pub. Date: Apr. 13, 2017

(65) Prior Publication Data

US 2018/0304641 A1 Oct. 25, 2018

Related U.S. Application Data

(60) Provisional application No. 62/238,769, filed on Oct. 8, 2015.

(51) Int. Cl.
*B41J 2/21* (2006.01)
*D06P 5/22* (2006.01)
(Continued)

(52) U.S. Cl.
CPC ..... *B41J 2/2139* (2013.01); *B41J 2/2142* (2013.01); *B41J 3/4078* (2013.01); *D06P 5/22* (2013.01); *D06P 5/30* (2013.01)

(58) Field of Classification Search
CPC ..... B41J 2/2139; B41J 2/2142; B41J 3/4078; D06P 5/22; D06P 5/30
See application file for complete search history.

(56) References Cited

U.S. PATENT DOCUMENTS 6,120,141 A 9/2000 Tajika et al.
2004/0172773 A1 9/2004 Kang et al.
(Continued)

FOREIGN PATENT DOCUMENTS

EP 0726156 8/1996
EP 1184185 3/2002
WO WO 2017/060902 4/2017

OTHER PUBLICATIONS

IP.com search (Year: 2019).*
(Continued)

*Primary Examiner* — Lisa Solomon

(57) ABSTRACT

Method and apparatus for digital printing of textiles with application of immobilization compound on the textile prior to printing. The method comprises, finding failed printing nozzles; carrying out immobilization of the textile without using at least some of the nozzles neighboring a failed printing nozzle; and printing the textile. The immobilization generally prevents the printing ink from running, so leaving out immobilization around the failed nozzle allows ink to seep into the unprinted gap. The immobilization however also stabilizes the ink, so one embodiment keeps some of the neighboring nozzles on during the immobilization.

20 Claims, 9 Drawing Sheets
(3 of 9 Drawing Sheet(s) Filed in Color)

(51) Int. Cl.
*D06P 5/30* (2006.01)
*B41J 3/407* (2006.01)

(56) References Cited

U.S. PATENT DOCUMENTS

| | | | |
|---|---|---|---|
| 2006/0203019 | A1 | 9/2006 | Yamanobe |
| 2006/0268034 | A1 | 11/2006 | Lee et al. |
| 2007/0024661 | A1 | 2/2007 | Kim et al. |
| 2015/0070428 | A1 | 3/2015 | Sudo et al. |

OTHER PUBLICATIONS

International Preliminary Report on Patentability dated Apr. 19, 2018 From the International Bureau of WIPO Re. Application No. PCT/IL2016/051080. (6 Pages).
International Search Report and the Written Opinion dated Jan. 18, 2017 From the International Searching Authority Re. Application No. PCT/IL2016/051080. (9 Pages).
Supplementary European Search Report and the European Search Opinion Dated Apr. 12, 2019 From the European Patent Office Re. Application No. 16853202.6.

* cited by examiner

CONCEALING MISSING NOZZLES

RELATED APPLICATIONS

This application is a National Phase of PCT Patent Application No. PCT/IL2016/051080 having International filing date of Oct. 5, 2016, which claims the benefit of priority under 35 USC § 119(e) of U.S. Provisional Patent Application No. 62/238,769 filed on Oct. 8, 2015. The contents of the above applications are all incorporated by reference as if fully set forth herein in their entirety.

FIELD AND BACKGROUND OF THE INVENTION

The present invention, in some embodiments thereof, relates to concealing of missing printing nozzles for inkjet textile printers and, more particularly, but not exclusively, to concealing missing nozzles in an inkjet textile printer that uses immobilization on the textile.

In inkjet printing in general, while using jetting nozzles, there is a common phenomenon most clearly visible on bright substrates as a bright thin line or gap. The phenomenon is the result of a failed nozzle.

In each printing head there are hundreds of nozzles. From time to time, nozzles stop functioning for various reasons such as clogging, electrical failure etc. A missing nozzle may appear very meaningfully on the image as a strike or a gap. This is even more severely noticeable when the image is built of a solid color area.

Textile digital printing technology may use an immobilization mechanism in which an immobilization agent is jetted through printing nozzles in immobilization phase. The immobilization phase may be carried out shortly before, during or immediately after application of the printing ink. The immobilization agent within an immobilization fluid interacts with color ink drops that are also jetted from inkjet heads. The immobilization agent prevents the color ink drops from bleeding into the fabric or flowing into another color droplet. In addition, the interaction between the color ink drops and the immobilization fluid phase prevents the color ink drops from spreading on the fabric surface. The result is a sharp image and intense image color.

Accordingly, immobilization fluid drops are jetted on each specific location that color ink drops are planned to be located in the same way that the actual printing is carried out. In practice an image file separation which is the sum of all color file separations is prepared and then printed onto the fabric as an immobilization phase.

Color ink drops that are not immobilized tend to bleed into the substrate and spread. The final dot diameter without immobilization is much larger than same drop which is immobilized by the immobilization phase, leading to an even more noticeable effect of the bleeding than there would be without immobilization.

SUMMARY OF THE INVENTION

The present embodiments involve knowing which nozzles are blocked, and masking the immobilization fluid phase in the surrounding nozzles so that color ink bleeds across the unprinted stripe.

According to an aspect of some embodiments of the present invention there is provided a method for digital printing of a substrate with immobilization of the color printing ink, the method comprising:

finding failed printing nozzles;

carrying out immobilization treatment over the substrate without using at least some of nozzles neighboring a failed printing nozzle; and printing the substrate.

The method may comprise mapping the failed printing nozzles.

The method may comprise providing a mapping for immobilization fluid.

The method may comprise modifying the immobilization fluid mapping using a mask formed from the failed printing nozzles.

In an embodiment, the mask comprises an alternating on-off pixel mask or chess mask.

The method may be applied to regions of solid color, where the non-printed stripe is most noticeable.

The method may comprise carrying out image analysis on a test print out to identify the failed printing nozzles.

Typically, the substrate comprises textile, including woven textiles and felts.

The method may be applied to already formed garments or to textiles.

The invention extends to the textile or garment printed using the herein-described methods, and to a printer that prints using the herein-described methods.

According to a further aspect of the present invention there is provided an apparatus for digital printing of a substrate with immobilization of the color printing ink, the apparatus comprising:

a printhead comprising a plurality of printing nozzles;

a nozzle failure analyzer configured to find failed printing nozzles;

an immobilization controller configured to carry out a modified operation of the print head to carry out immobilization treatment on the substrate without using at least some of nozzles neighboring a failed printing nozzle; and a print controller configured to operate the print head to print color printing ink on the substrate, thereby allowing the color printing ink to bleed into a print region of the failed printing nozzle.

In an embodiment, the nozzle failure analyzer is configured to map the failed printing nozzles.

In an embodiment, the immobilization controller is configured to map the immobilization.

In an embodiment, the immobilization mapper is configured to modify the immobilization mapping using a mask formed from the failed printing nozzles.

In an embodiment, the mask comprises an alternating on-off pixel mask.

The apparatus may carry out the modified operation particularly or specifically for regions of solid color, where the non-printed stripe would be most noticeable.

In an embodiment, the nozzle failure analyzer is configured to carry out image analysis on a test print out to identify the failed printing nozzles.

According to a third aspect of the present invention there is provided a textile comprising printed color ink drops, the printed color ink drops comprising:

a first plurality of fixed ink drops fixed on the textile by an immobilization phase; and a second plurality of ink drops enlarged relative to the first plurality of fixed ink drops, by bleeding into the textile.

The textile may be a textile roll, or may be manufactured into a garment or the like. The term "garment" used herein includes curtains, drapes, bedclothes and materials for tents.

According to a fourth aspect of the present invention there is provided a method for digital printing of a substrate with immobilization of the printing ink, the digital printing and immobilization treatment using nozzles, the method comprising:

controllably selecting ones of the nozzles; and carrying out the immobilization treatment using the selected nozzles while printing the textile.

In an embodiment, the controllably selecting ones of the nozzles comprises modifying an immobilization map and carrying out the selecting using the map.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE SEVERAL VIEWS OF THE DRAWINGS

The patent or application file contains at least one drawing executed in color. Copies of this patent or patent application publication with color drawing(s) will be provided by the Office upon request and payment of the necessary fee.

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 1 is a simplified diagram showing a test print in which a nozzle failure crosses different regions including a block of bright color, a block of pale color and text;

FIG. 2 is a simplified diagram showing a pre-printing map or separation and a printing map or separation;

FIG. 3 is a simplified diagram showing a printing separation;

FIG. 4 is a simplified diagram showing how the printing separation is modified by the failure of a single nozzle;

FIG. 5 is a simplified diagram showing how the pre-printing separation may be modified according to the present embodiments in order to overcome the missing nozzle in FIG. 4;

FIG. 6 is a simplified diagram showing the result of printing using the missing nozzle of FIG. 4 and the printing separation of FIG. 5;

FIG. 7 is a simplified flow diagram showing a method of printing textiles in the presence of failed nozzles according to embodiments of the present invention;

FIG. 8 is a simplified diagram illustrating use of a mask to modify the method of FIG. 7 in order to make the printed textile more resilient to washing;

FIG. 9 is a simplified flow diagram illustrating a method of printing textiles in the presence of failed nozzles using the mask of FIG. 8;

FIG. 10 is a simplified flow diagram showing in greater detail the use of the mask to modify the immobilization separation;

FIG. 11 is a simplified block diagram illustrating textile printing apparatus with immobilization and designed to print in a way that is resilient to missing nozzles, according to embodiments of the present invention; and FIG. 12 is a simplified flow chart illustrating modification of an immobilization separation according to embodiments of the present invention.

DESCRIPTION OF SPECIFIC EMBODIMENTS OF THE INVENTION

The present invention, in some embodiments thereof, relates to printing nozzles for inkjet textile printers and, more particularly, but not exclusively, to an inkjet textile printer that uses immobilization on the textile.

The method comprises finding failed printing nozzles, carrying out immobilization of the textile while switching off and thus not using at least some of the nozzles neighboring a failed printing nozzle; and then printing the textile. The immobilization generally prevents the color printing ink from running, so leaving out immobilization around the failed nozzle allows color ink to seep into the unprinted gap that arises because of a blocked nozzle. The immobilization however also stabilizes the ink, so one embodiment keeps some of the neighboring nozzles on during the immobilization phase so that the area around the failed nozzle is at least partially immobilized.

More specifically, the blocked nozzle is identified. In addition, regions may be distinguished, such as blocks of monolithic bright color, where unprinted stripes would most stand out. Then, particularly but not exclusively within such regions, nozzles around the blocked nozzle are identified and removed from the mapping or separation used for preprinting. Removal of the nozzles means that pixels around the blocked nozzle are not pretreated. The lack of immobilization allows for pixels immediately around the unprinted stripe to bleed into the unprinted stripe and thus color the unprinted stripe, leaving the stripe undetectable or substantially undetectable.

More generally, the immobilization treatment may be controlled by selecting which of the available printing nozzles to use for immobilization treatment. The selection may be carried out by generating an immobilization map that defines the printing nozzles to be used.

Figure 1:
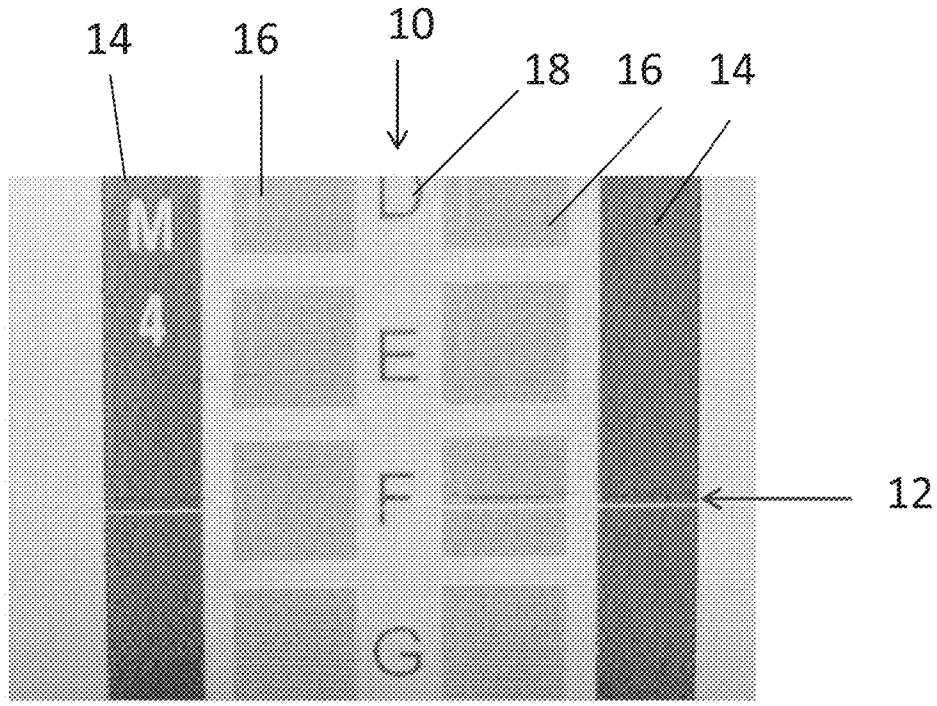

For purposes of better understanding some embodiments of the present invention, as illustrated in FIGS. 3-10 of the drawings, reference is first made to the construction and operation of a conventional printer with a blocked nozzle as illustrated in FIG. 1. FIG. 1 shows a test print 10 produced by a printer with a blocked nozzle. The blocked nozzle produces blank strip 12 which extends across the test print. The test print includes blocks of bright color 14, blocks of pale color 16 and lettering 18. While the blank strip is visible in all of the different parts of the test strip, it is most noticeable in the solid color regions and in particular in the strong color region.

Figure 2:
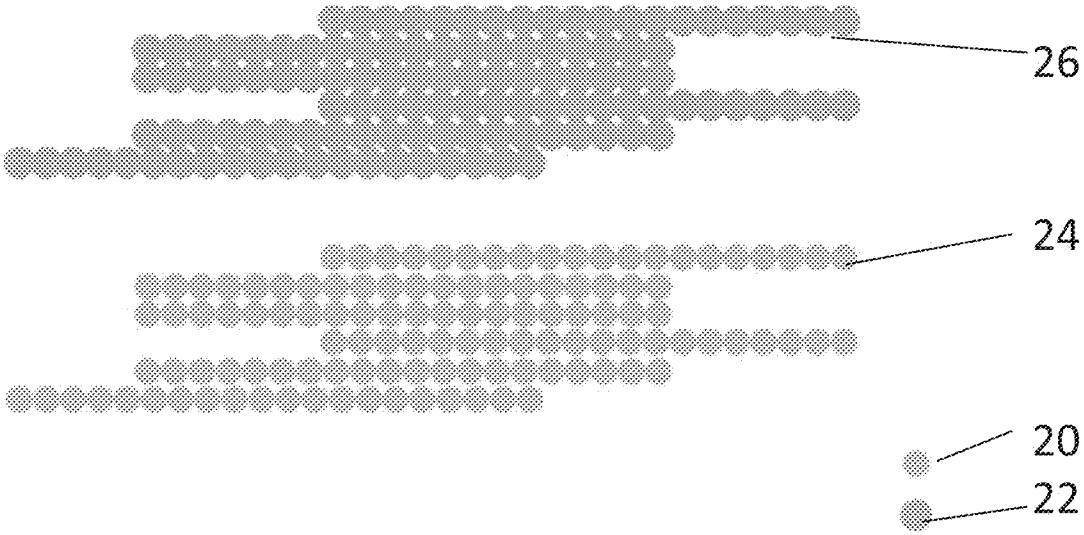

FIG. 2 shows immobilization and printing mappings. The blue dots 20 are color pixels it is intended to print on a fabric. The grey dots 22 are pixels of immobilization treatment which may be printed concomitantly with the color drops on the fabric to immobilize the color ink in the fabric when printed. In practice the grey dots are not grey of course but rather transparent.

The blue dots 20 form a printing map 24 and the grey dots form an immobilization map 26. In normal circumstances the two maps are identical so that every pixel is printed on a target which contains drops of immobilization compound.

It is noted that the immobilization pixels are larger than the printing dots as the immobilization fluid is not in itself immobilized in the textile. It is noted that herein the term pixel refers to the electronic image in the mapping of dots to be printed on the textile by an individual jet of printing ink from a nozzle on the printhead.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 3:
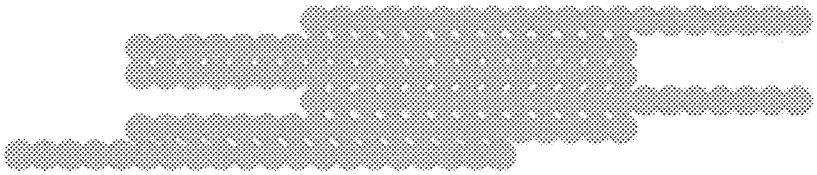
Figure 4:
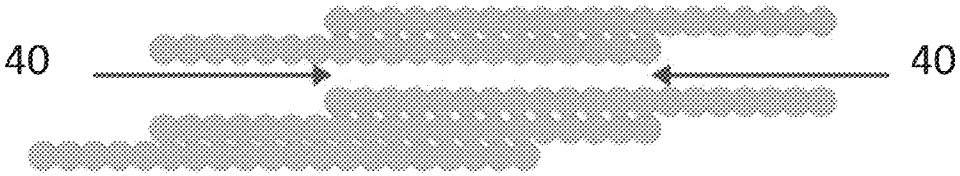

Referring now to the drawings, FIG. 3 illustrates the same mapping for color printing shown in FIG. 2. FIG. 4 shows the mapping of FIG. 3 with a row 40-40 of color ink droplets missing due to the failure of a nozzle.

Figure 5:
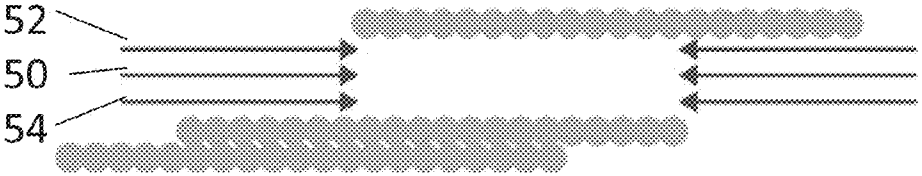
Figure 6:
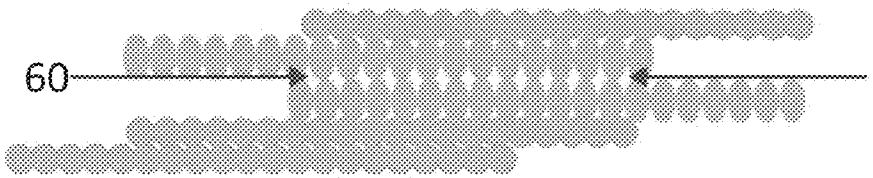

In greater detail the present embodiments provide a compensation method to compensate for the disruption in appearance of the printed outcome on a textile or fabric caused by a non-functioning inkjet nozzle. The compensation method reduces the uneven appearance in the printed outcome caused by the missing nozzle. As illustrated in FIG. 5, the uneven appearance may be masked by deactivating the immobilization ink in the row 50 of the inactivated nozzle and also in the two neighboring rows on either side 52 and 54. FIG. 6 shows the result. The two neighboring rows are printed and the ink runs, allowing the spreading of those color ink drops that did not encounter the immobilization fluid through the fabric. The non-immobilized color ink drops enlarge—60, and thus create a region of smoothly printed solid color that obscures the blank stripe of the missing nozzle.

That is to say, according to the present embodiments, an immobilization separation file is prepared in such a way that immobilization fluid drop jetting is canceled in the location 50, where the color printing ink drops are going to be missing 40. In addition, neighboring immobilization fluid drops 52 and 54 are also canceled.

Due to the lack of immobilization, color ink drops that are positioned near the gap caused by the missing nozzle run through the fabric and become enlarged compared to other drops—60, thus covering the missing area. The result is a more uniform image without visible strikes.

Figure 7:
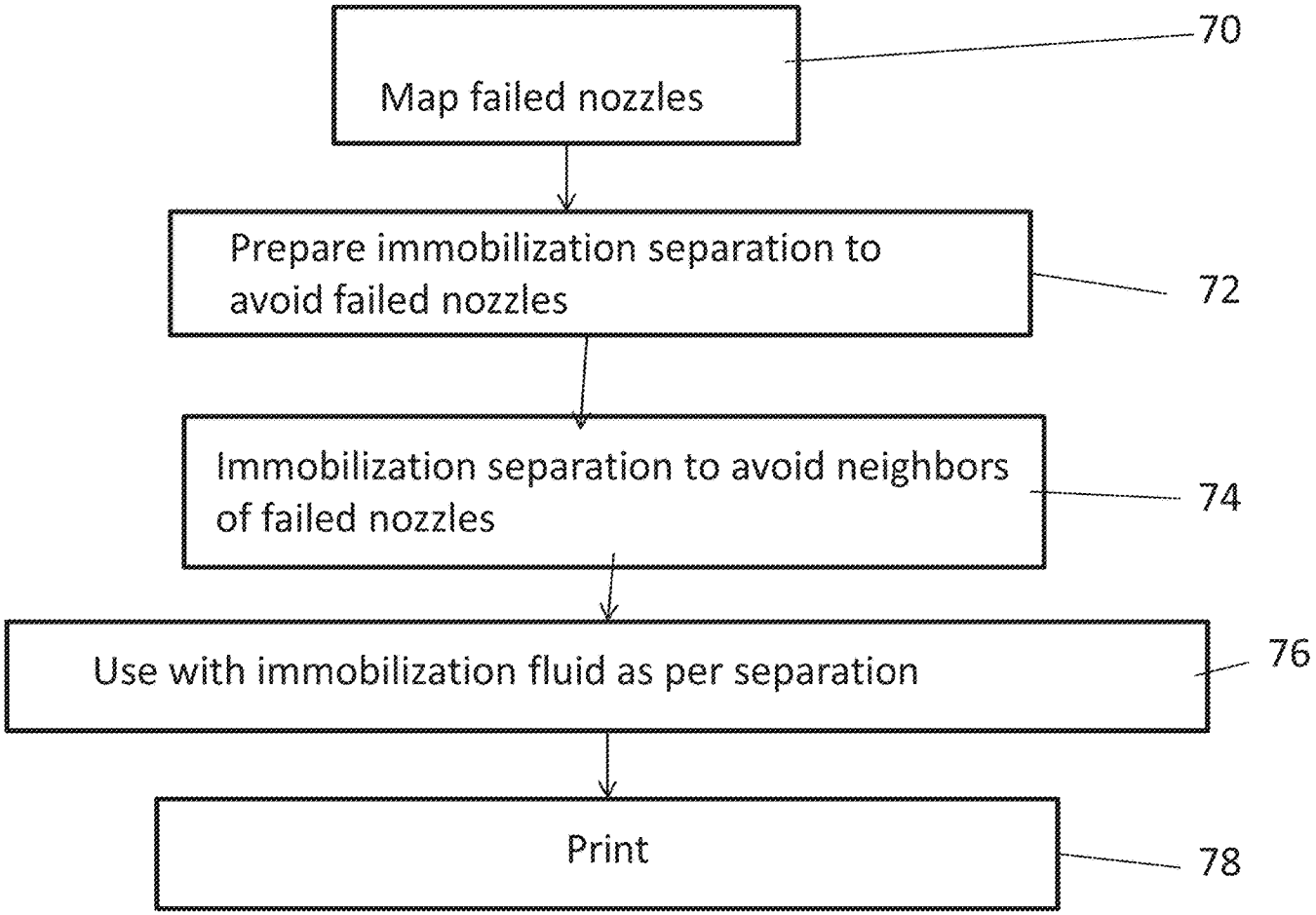

Reference is now made to FIG. 7, which is a simplified diagram showing a printing process for printing textiles in the face of failed nozzles according to an embodiment of the present invention. The method involves finding failed printing nozzles, carrying out immobilization of the textile without using at least some of nozzles neighboring a failed printing nozzle; and then printing the textile. In FIG. 7, ink nozzles that are not functioning are initially found and may be mapped 70. One way to carry out such mapping is to print a test pattern such as that shown in FIG. 1 and to use image analysis to identify gaps such as gap 12 in FIG. 1. The identified gaps may then be associated with corresponding nozzles which may be recognized as failed nozzles.

Then, as discussed, the software may prepare the pretreatment mapping, or immobilization ink separation, in such a way that immobilization fluid drops are skipped wherever the color ink drops are missing 72. In addition the neighboring nozzles are also deleted from the immobilization separation—74. The immobilization is carried out according to the separation, 76 and printing using the colored inks is carried out. Thus, as explained, the ink droplets produced by the nozzles near the missing strip expand and cover the blank/uncovered area of the missing strip. As discussed above, the immobilization and printing may be carried either together or successively.

Figure 8:
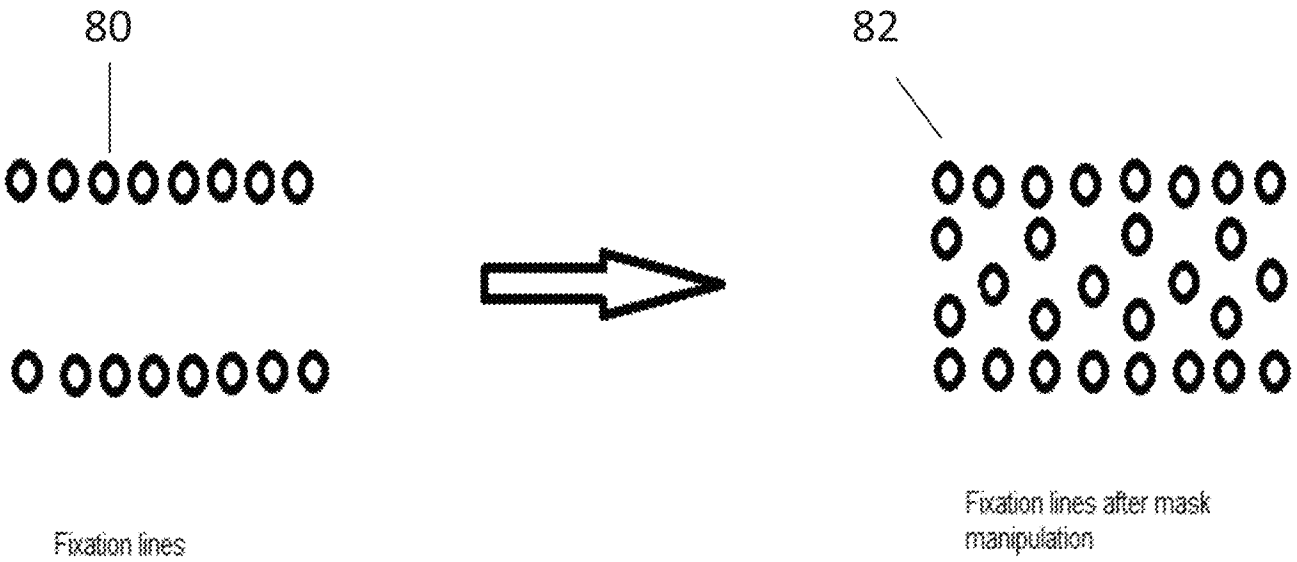

Reference is now made to FIG. 8, which is a simplified diagram showing a further embodiment of the present invention. On the left hand of the figure, 80 are fixation lines of the immobilization separation according to the previous embodiment. On the right hand side of the figure —82—the fixation lines are multiplied with a mask. Since the software prepares the separation for the immobilization ink, the same can create a mask and use the mask to modify the immobilization process.

The motivation for using such a mask is that without immobilization the ink may not be stable in the textile. Use of the mask may spread at least some immobilization fluid in the region of the missing nozzle and thus partly immobilize the color ink around the missing strip on the fabric. There is less immobilization fluid so that the color ink runs into the blank area but there is enough immobilization fluid to stabilize the color ink so that color ink remains after washing. The outcome may thus be stable color ink coverage of the missing nozzle area on the fabric.

Figure 9:
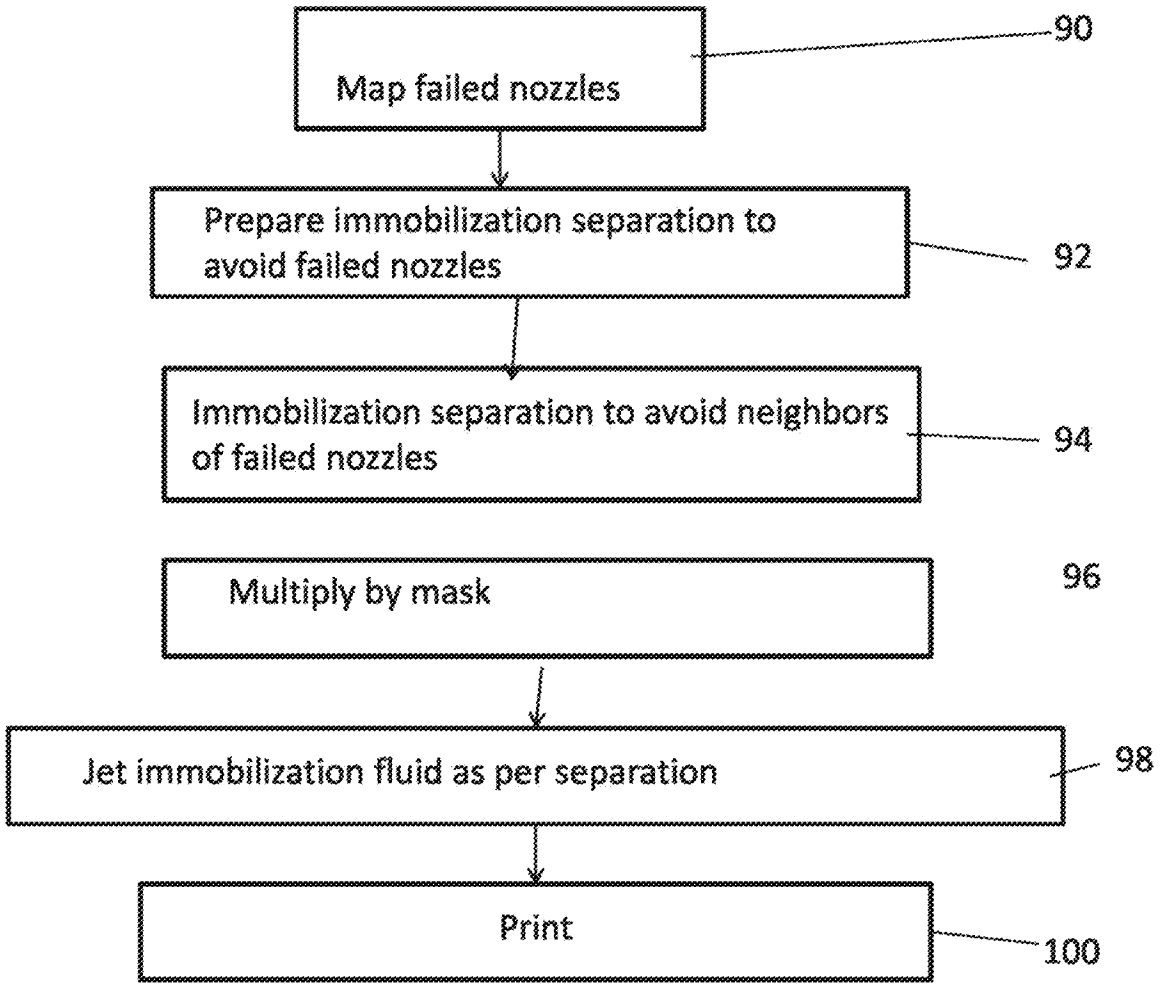

Reference is now made to FIG. 9, which is a simplified diagram showing a printing process for printing textiles in the face of failed nozzles according to the embodiment of FIG. 8. In FIG. 9, printing nozzles that are not functioning are initially mapped 90 as discussed above.

Then, as before, the software may prepare the immobilization fluid separation in such a way that immobilization fluid drops are skipped wherever the color ink drops are missing 92. In addition the neighboring drops are also deleted from the immobilization separation—94. In box 96, a chessboard-type mask or similar filter may be multiplied with the separation prepared in boxes 92 and 94. The process may go over the rows that were eliminated and multiply by the selected mask so that certain spots in these rows are reinstated, for example every second spot is reinstated. This still allows the drops to spread but also partially immobilizes so that the color ink is stabilized. After washing the color ink remains on the fabric and the outcome may be stable coverage of the blank strip that would otherwise slowly become visible on the fabric as the fabric is washed.

Figure 10:
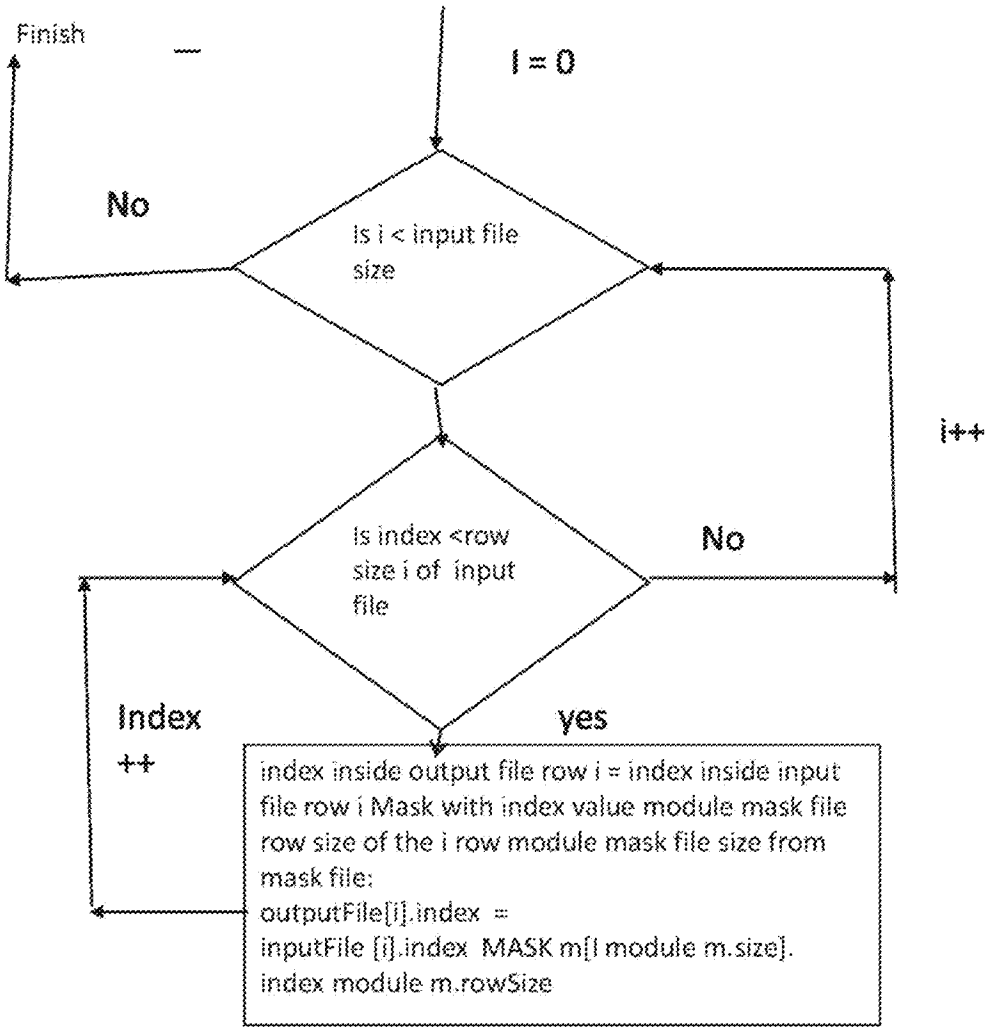

Table 1 and corresponding FIG. 10 illustrate the pseudo code for the masking process as outlined above, in which the initial separation file is masked as described.

TABLE 1

Pseudocode for masking.
Pseudo code algorithm:

```
File inputFile;
File outputFile;
Mask m; //Mask file
// For each line I in input file
For( I = 0 until I < inputFile.size)
{
    // For each byte in line I in input file
For(index = 0 until index < inputFile [i].rowSize)
{
outputFile[i].index =
inputFile [i].index MASK m[I module m.size]. index module m.rowSize;
}
}
Where MASK can be a bitwise AND operator (&&) or other operations.
inputFile is the original input file to print,
outputFile is the actual result to print after manipulation.
inputFile and outputFile files have the same size.
m is the mask file.
inputFile.size is the size of input file, which is input file height, equals to
num of rows in file.
m.size is the size of mask file, which is mask file height, equals to num of
rows in file.
rowSize is the amount of bytes in one line of file.
```

Figure 11:
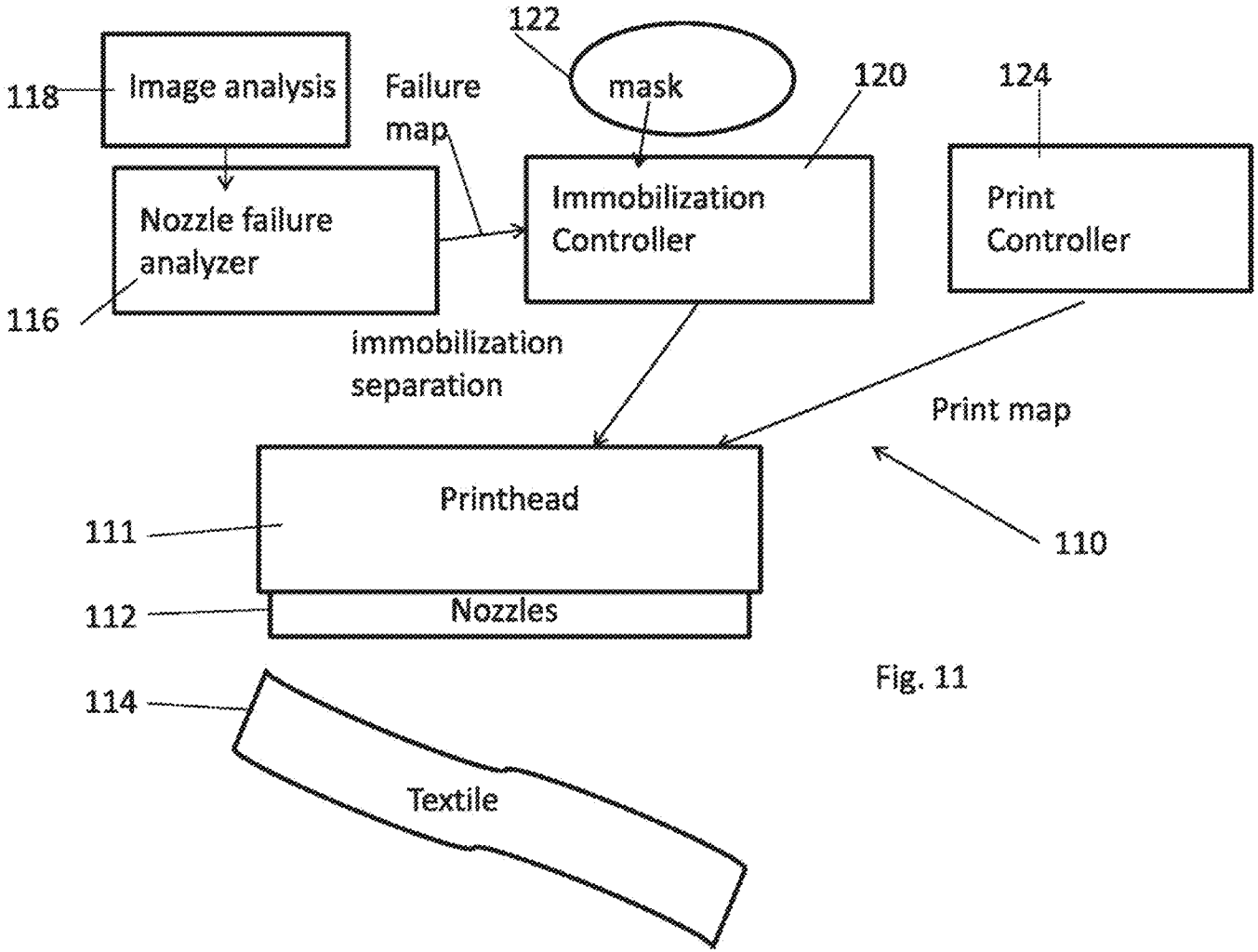

Reference is now made to FIG. 11, which is a simplified block diagram illustrating apparatus for printing a textile according to the present embodiments with immobilization to immobilize the color ink and mapping of the immobilization in view of failed nozzles to reduce or remove the amount of immobilization around the failed nozzle.

Apparatus 110 comprises a printhead 111 which includes multiple printing nozzles in nozzle region 112. Textile 114 passes below the printhead to be printed with jets of immobilization fluid and color ink from the nozzles.

A nozzle failure analyzer 116 finds and maps failed printing nozzles, typically using image analysis 118 of test prints as in FIG. 1.

As explained above, the expression "immobilization" is used to describe the application of immobilization fluid—which may be applied a short time prior to or post the color ink drop application or together with the color ink drops.

An immobilization controller 120 receives a failure map of the failed nozzles discovered by the image analysis. The immobilization controller may have an immobilization or separation map which is typically identical to a print map for the current print operation. The immobilization map is then modified by the failure map to switch off nozzles neighboring the failed nozzles. Mask 122 may then be used to switch on some of the nozzles switched off in the previous stage. The final immobilization map is then used to operate the print head 111 to carry out immobilization of the textile 114, wherein some or all of the nozzles neighboring the failed nozzles are not used.

Print controller 124 then operates the print head to print the pretreated textile 114.

The modification of the immobilization area may be carried out in particular for those areas of the textile which are solid blocks of bright color, as these are the regions where missing nozzles are most noticeable.

The textile being printed may be a sheet or roll of textile, or may be a ready formed garment, of any kind of fabric.

Figure 12:
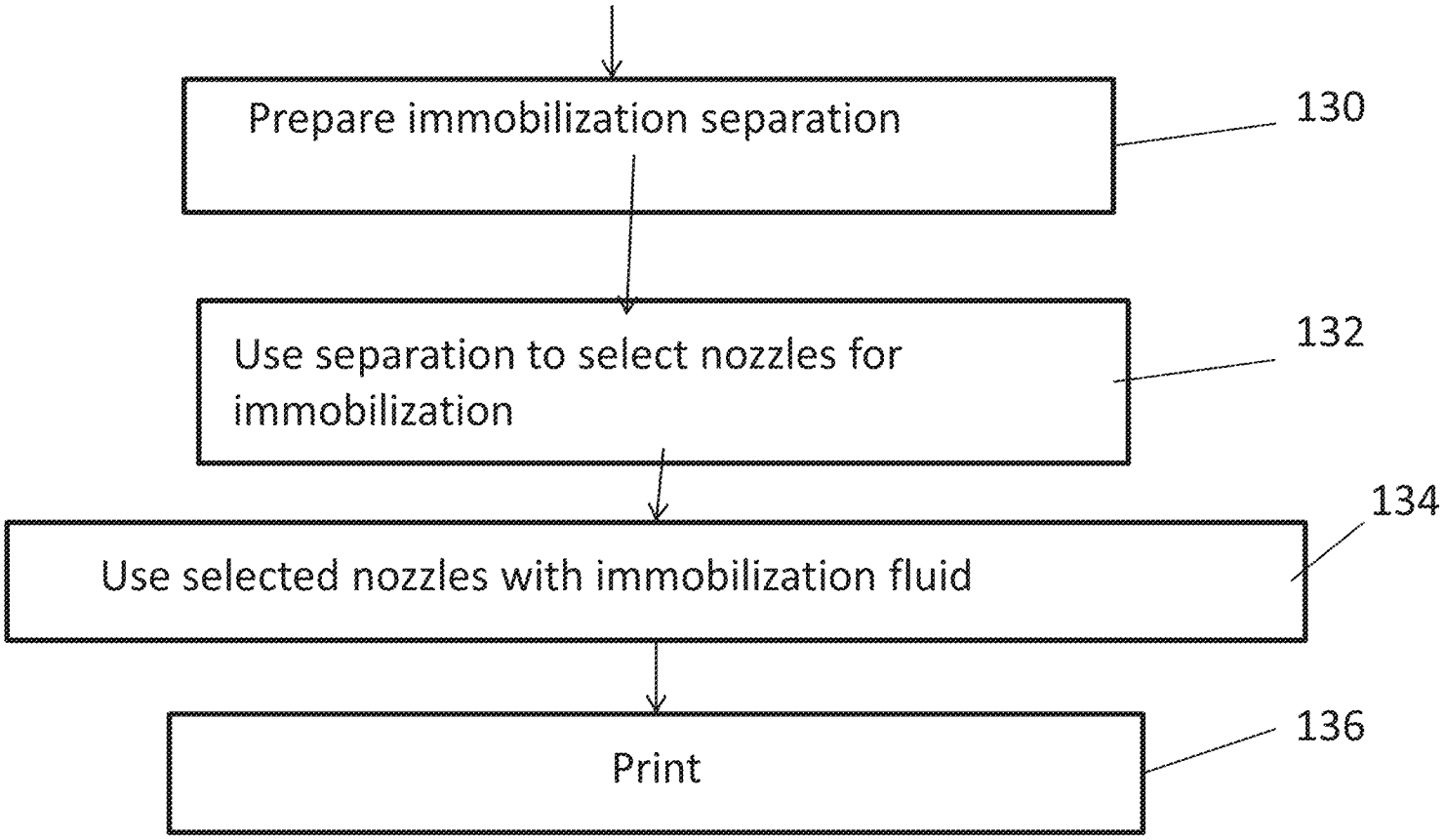

Reference is now made to FIG. 12 which illustrates a further embodiment of the present invention, in which immobilization treatment is carried out using selected nozzles. The idea is to carry out controlled immobilization and consequent controlled printing.

In box 130 an immobilization separation is prepared, spatially defining the immobilization to be carried out. In box 132 the separation is used to select print head nozzles for the immobilization treatment and then in box 134 immobilization fluid is fed to the selected nozzles but not to the non-selected nozzles. In box 136 printing is carried out. Boxes 134 and 136 may be carried out simultaneously or one slightly before the other, the order not being significant.

It is expected that during the life of a patent maturing from this application many relevant ink jet, textile printing, types of textiles and types of suitable substrates in general, and ink immobilizing technologies will be developed and the scopes of the corresponding terms are intended to include all such new technologies a priori.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment, and the above description is to be construed as if this combination were explicitly written. Conversely, various features of the invention, which are, for brevity, described in the context of a single embodiment, may also be provided separately or in any suitable subcombination or as suitable in any other described embodiment of the invention, and the above description is to be construed as if these separate embodiments were explicitly written. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. Method for digital printing of a substrate with immobilization of the color printing ink, the method comprising:

finding failed printing nozzles;

carrying out immobilization treatment over the substrate without using at least some of nozzles neighboring a failed printing nozzle; and printing the substrate.

2. The method of claim 1, comprising mapping said failed printing nozzles.

3. The method of claim 1, comprising providing a mapping for immobilization fluid.

4. The method of claim 3, comprising modifying said immobilization fluid mapping using a mask formed from said failed printing nozzles.

5. The method of claim 4, wherein said mask comprises an alternating on-off pixel mask (chess mask).

6. The method of claim 1, applied to regions of solid color.

7. The method of claim 1, comprising carrying out image analysis on a test print out to identify said failed printing nozzles.

8. The method of claim 1, wherein the substrate comprises textile.

9. The method of claim 1, applied to garments.

10. A textile or garment printed using the method of claim 1.

11. A printer configured to print a textile using the method of claim 1.

12. Apparatus for digital printing of a substrate with immobilization of the color printing ink, the apparatus comprising:

a printhead comprising a plurality of printing nozzles;

a nozzle failure analyzer configured to find failed printing nozzles;

an immobilization controller configured to carry out a modified operation of said print head to carry out immobilization treatment on the substrate without using at least some of nozzles neighboring a failed printing nozzle; and a print controller configured to operate said print head to print color printing ink on the substrate, thereby allowing said color printing ink to bleed into a print region of said failed printing nozzle.

13. The apparatus of claim 12, wherein said nozzle failure analyzer is configured to map said failed printing nozzles.

14. The apparatus of claim 12, wherein said immobilization controller is configured to map said immobilization.

15. The apparatus of claim 14, wherein said immobilization mapper is configured to modify said immobilization mapping using a mask formed from said failed printing nozzles.

16. The apparatus of claim 15, wherein said mask comprises an alternating on-off pixel mask.

17. The apparatus of claim 12, configured to carry out said modified operation for regions of solid color.

18. The apparatus of claim 12, wherein said nozzle failure analyzer is configured to carry out image analysis on a test print out to identify said failed printing nozzles.

19. The apparatus of claim 12, wherein said substrate comprises textile.

20. Method for digital printing of a substrate with immobilization of the printing ink, the digital printing and immobilization treatment using nozzles, the method comprising:

controllably selecting ones of said nozzles; and carrying out said immobilization treatment using said selected nozzles while printing the textile, wherein said controllably selecting ones of said nozzles comprises modifying an immobilization map and carrying out said selecting using said map.

* * * * *